US005245979A

United States Patent [19]

Pursifull et al.

[11] Patent Number: 5,245,979

[45] Date of Patent: Sep. 21, 1993

[54] OXYGEN SENSOR SYSTEM WITH A DYNAMIC HEATER MALFUNCTION DETECTOR

[75] Inventors: Ross D. Pursifull; Julie A. Konrad, both of Dearborn; Robert W. Ridgway, Royal Oak, all of Mich.

[73] Assignee: Ford Motor Company, Dearborn, Mich.

[21] Appl. No.: 967,342

[22] Filed: Oct. 28, 1992

[51] Int. Cl.[5] ..... F02D 41/14

[52] U.S. Cl. ..... 123/690; 123/697

[58] Field of Search ..... 123/690, 697, 479; 60/274

[56] References Cited

U.S. PATENT DOCUMENTS

| | | | |
|---|---|---|---|
| 4,715,343 | 12/1987 | Kinoshita | 123/697 X |
| 4,724,815 | 2/1988 | Mieno et al. | 123/479 |
| 4,905,469 | 3/1990 | Matsuoka | 60/274 |
| 4,941,318 | 7/1990 | Matsuoka | 60/274 |
| 4,958,611 | 9/1990 | Uchinami et al. | 123/479 |
| 4,993,392 | 2/1991 | Tanaka et al. | 123/697 X |
| 5,054,452 | 10/1991 | Denz | 123/479 |
| 5,111,792 | 5/1992 | Nagai et al. | 123/697 X |
| 5,148,795 | 9/1992 | Nagai et al. | 123/697 |

*Primary Examiner*—Willis R. Wolfe

[57] ABSTRACT

A heated exhaust gas oxygen sensor assembly for an internal combustion engine that changes the heater status in order to detect a malfunction of the heater. The assembly includes an oxygen sensor, heater, impedance sensor, and controller. The oxygen sensor has a sensing element and a pair of output leads. The sensing element detects the relative oxygen concentration in the exhaust gas and responsively provides an oxygen level signal on the output leads. The heater physically warms the oxygen sensor. The impedance sensor is interconnected to the output leads of the oxygen sensor and measures the impedance between them. The controller first activates and then deactivates the heater. The controller also receives the impedance signals representing the impedance of the oxygen sensor when the heater is both on and off. The controller compares these two impedance levels and, if the difference between (or ratio of) these two values fails to meet a predetermined standard, the controller issues a heater malfunction signal. The malfunction signal may then alert the driver or mechanic that a heater malfunction has been detected.

12 Claims, 7 Drawing Sheets

80
42
54
82
84
38
HEGO SENSOR
SWITCH
86
INTERFACE
ENGINE CONTROLLER
88
56

90
42
82
54
V
92
94
84
38
HEGO SENSOR
INTERFACE
ENGINE CONTROLLER
56

42
54
99
98
84
38
A.C. CURRENT SOURCE
HEGO SENSOR
INTERFACE
ENGINE CONTROLLER
56

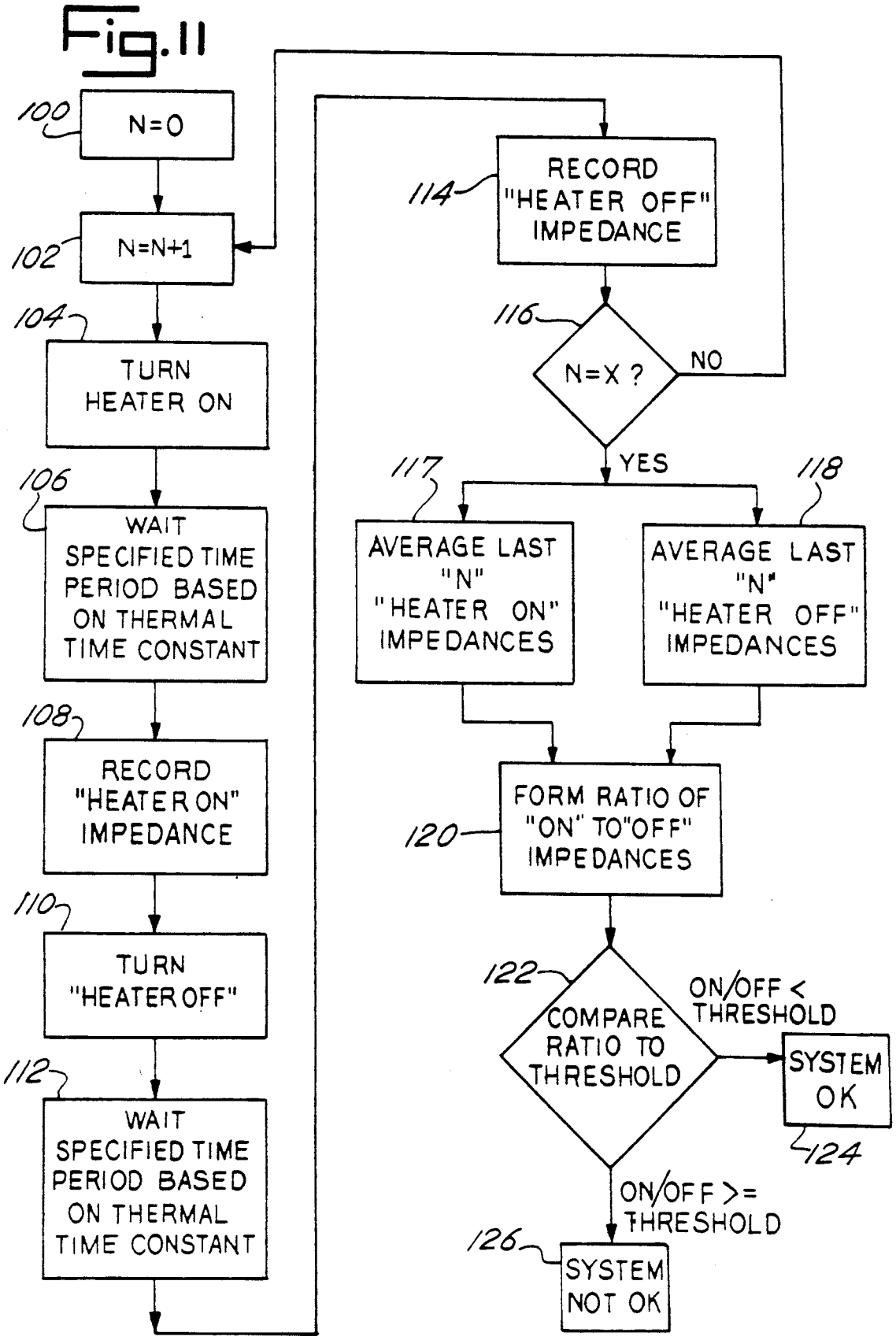
Fig. 11
100
N=0
102
N=N+1
104
TURN HEATER ON
106
WAIT SPECIFIED TIME PERIOD BASED ON THERMAL TIME CONSTANT
108
RECORD "HEATER ON" IMPEDANCE
110
TURN "HEATER OFF"
112
WAIT SPECIFIED TIME PERIOD BASED ON THERMAL TIME CONSTANT
114
RECORD "HEATER OFF" IMPEDANCE
116
N=X ?
NO
YES
117
AVERAGE LAST "N" "HEATER ON" IMPEDANCES
118
AVERAGE LAST "N" "HEATER OFF" IMPEDANCES
120
FORM RATIO OF "ON" TO "OFF" IMPEDANCES
122
COMPARE RATIO TO THRESHOLD
ON/OFF < THRESHOLD
SYSTEM OK
124
ON/OFF >= THRESHOLD
126
SYSTEM NOT OK

OXYGEN SENSOR SYSTEM WITH A DYNAMIC HEATER MALFUNCTION DETECTOR

RELATED APPLICATION

The present patent application relates to another U.S. patent application, entitled Oxygen Sensor System with an Automatic Heater Malfunction Detector, U.S. patent application No. 967,314 filed Oct. 28, 1992, and which has the same inventors as the present patent application. The disclosure of this related application is incorporated herein by reference.

BACKGROUND OF THE INVENTION

The present application relates generally to oxygen sensor systems that are frequently found within the exhaust systems of automotive vehicles and, more particularly, to a dynamic malfunction detector for a heater within a Heated Exhaust Gas Oxygen ("HEGO") sensor assembly. Many automotive vehicles include an internal combustion engine and an exhaust system that provides a conduit for exhaust gas to move away from the engine. The temperature of the exhaust gases ranges from ambient temperature, when the engine has not been in operation recently, to 400° Celsius ("C") or more.

A HEGO sensor assembly includes a sensing element and an associated pair of electrical output leads, as well as the heater. The sensing element is placed in the stream of exhaust gas passing through the exhaust system. The HEGO sensor then detects the oxygen level after equilibration and provides an electrical signal on the pair of output leads. The signal on the output leads may then be used, for example, by the vehicle's fuel delivery system to adjust the air/fuel mixture being provided to the combustion chambers of the vehicle's engine.

The HEGO sensor should detect the oxygen level in the exhaust gas, where the temperature of the gas varies over a wide range. To assist the HEGO sensor in making accurate measurements over a wide range of exhaust gas temperatures, a HEGO sensor assembly generally includes an electrical heater physically adjacent, or near, the HEGO sensor. When actuated, the electrical heater warms the HEGO sensor to enable it to make more accurate measurements and thus lower its sensitivity to the temperature of the exhaust gas.

Prior art systems exist for detecting faults in a HEGO sensor assembly. For example, U.S. Pat. No. 4,724,815, issued to Mieno et al., relates to a system of abnormality detection for an oxygen concentration sensor. The patent discloses a heater malfunction detection system for a Universal Exhaust Gas Oxygen ("UEGO") sensor assembly in which the detection of a malfunction of a heater is based, in part, upon a measurement of voltage between the electrodes of the UEGO sensor.

Since HEGO sensor assemblies are generally mass-produced and put on many cars, even a small savings on one part of the assembly can accumulate to substantial annual savings for a car manufacturer. Moreover, it is important that a HEGO sensor assembly, and the fault detection system within such an assembly, be reliable.

Unfortunately, many presently available systems require the use of additional components to measure a heater's effectiveness, thus increasing the cost and complexity of the HEGO sensor assembly. Other devices only indirectly determine whether the heater of a HEGO sensor assembly is functioning correctly.

Still other devices may not test the operation of the HEGO heater after the engine has been started and running for an extended period of time. As a result, a substantial delay may occur between the actual heater malfunction and the subsequent testing of the heater to detect the malfunction. Moreover, other detectors may spuriously sense a heater's operation and incorrectly signal that the heater is operating properly.

SUMMARY OF THE INVENTION

The present invention is a heated exhaust gas sensor assembly for an internal combustion engine that changes the operation of the heater during operation to detect malfunctions. The system includes an oxygen sensor, heater, impedance sensor, and controller.

The oxygen sensor has a sensing element and associated pair of output leads. The sensing element detects oxygen and responsively provides an equilibrated oxygen level signal on the pair of output leads. The heater physically warms the oxygen sensor. The impedance sensor is connected to the oxygen sensor's output leads. The impedance sensor detects the impedance between the output leads and issues an impedance signal.

The controller is interconnected to both the impedance sensor and the heater power control. The controller is capable of activating and deactivating the heater. The controller also receives the impedance signal from the impedance sensor and, thus, may receive an indication of the impedance between the output leads when the heater is both on and off. The controller compares the impedance values represented by these two impedance signals to determine an impedance difference. Thereafter, the controller issues a heater malfunction signal when the difference is less than a predetermined threshold.

Yet another embodiment of the present invention is a process for determining whether the heater in a heated exhaust gas oxygen sensor assembly has malfunctioned. The process includes the steps of first activating the heater and waiting a predetermined interval. The impedance between the output leads of the sensor is then measured in order to determine a "heater-on" impedance level. Thereafter, the heater is deactivated, and, after waiting a predetermined period of time, the heater impedance is again measured to determine a "heater-off" impedance level. The heater-on and heater-off impedance levels are compared, and an alarm signal is produced if the difference is less than a predetermined threshold.

BRIEF DESCRIPTION OF THE DRAWINGS

Preferred embodiments of the present invention are described herein with reference to the drawings wherein:

FIG. 11 is a flow chart showing the process used by the embodiments shown in FIGS. 8–10.

DETAILED DESCRIPTION OF THE PREFERRED EMBODIMENTS

Figure 1:
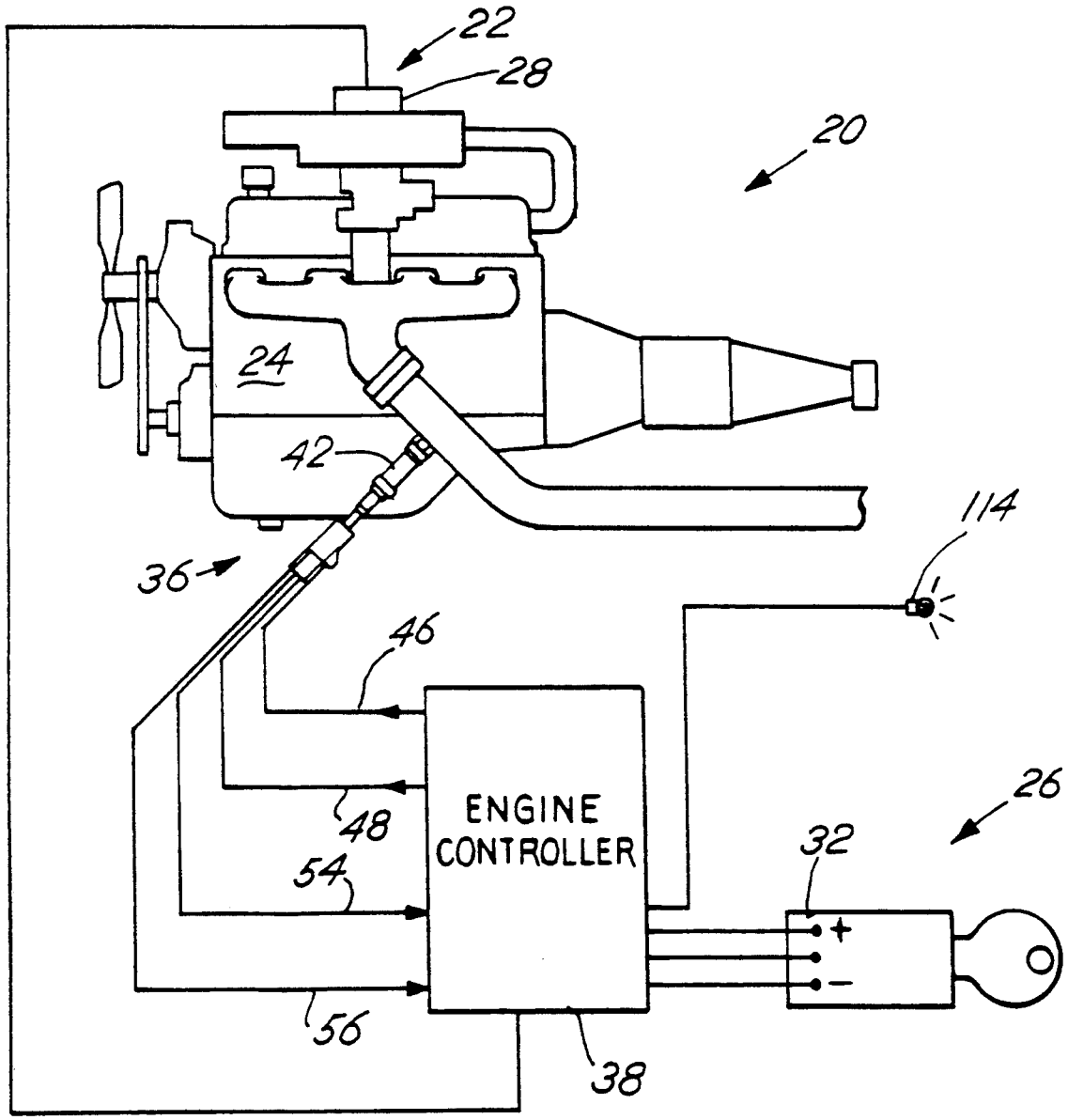
FIG. 1 is a diagram of a HEGO sensor assembly interconnected to the exhaust system of an internal combustion engine.
Figure 2:
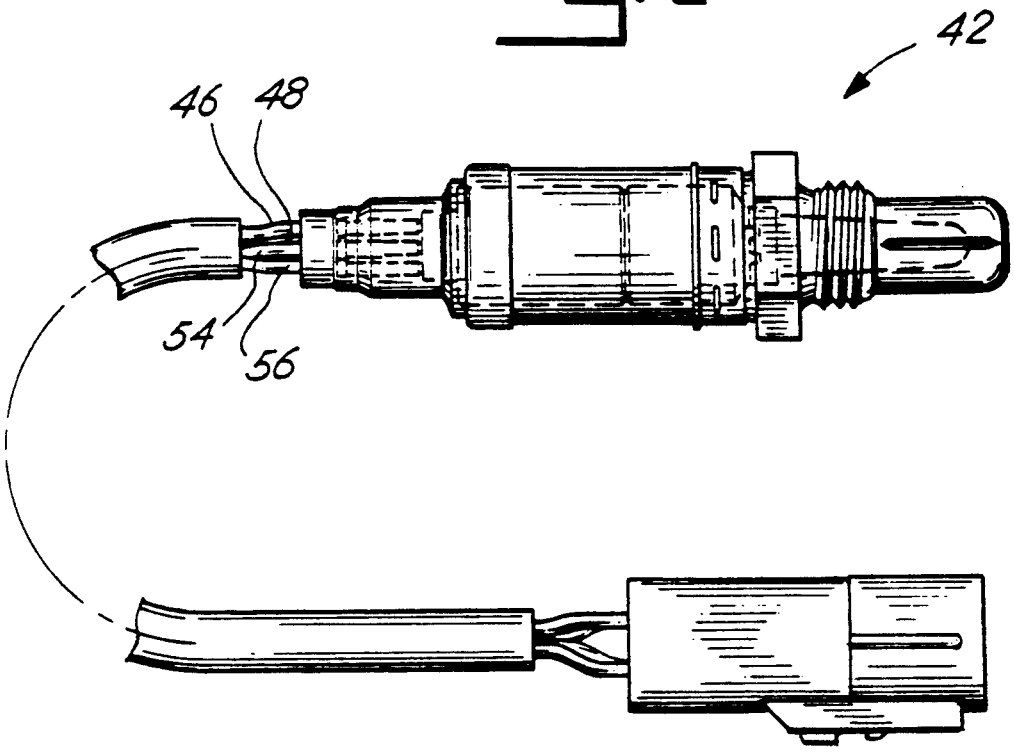
FIG. 2 is a side view of the HEGO sensor assembly shown in FIG. 1.
Figure 3:
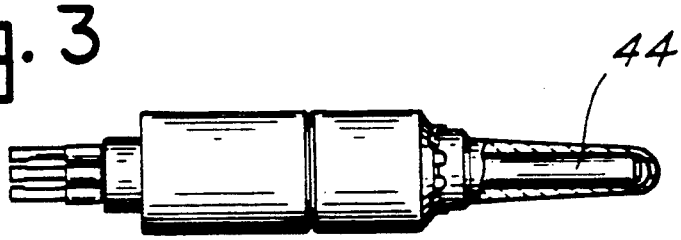
FIG. 3 is a partial cross-sectional view of the HEGO sensor assembly shown in FIG. 2.
Figure 4:
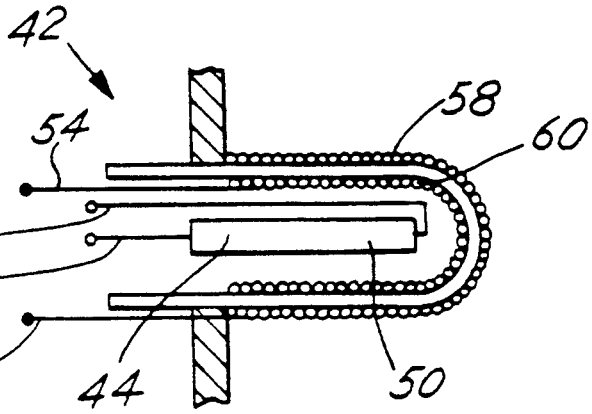
FIG. 4 is a simplified representation of the HEGO sensor assembly shown in FIG. 2.

Referring to FIGS. 1–11, a preferred embodiment of the present invention as shown as a HEGO sensor system 20 for use with an internal combustion engine 22. As shown in FIG. 1, the engine 22 includes an engine block 24 having internal cylinders (not shown), in which combustion takes place, a crankshaft (not shown), a vehicle power control 26, a fuel delivery system 28, and an exhaust system 30.

The power control 26 includes an power switch 32 that may be manually rotated to first and second positions. For example, when the engine 22 is off, no internal combustion is occurring within the engine 22, and the crankshaft is stationary. When the power switch 32 is turned to a first position, the engine 22 may be considered as being in an initial state, since electrical power is supplied to electrical components of the engine 22, but no combustion is occurring within the engine 22. The power switch 32 may then be rotated to a second position, such that combustion begins within the engine 22. Alternatively, the engine 22 may, for example, be considered to be in an initial position only after the crankshaft begins rotating.

The exhaust system 30 includes an exhaust pipe 34, to carry exhaust gas away from the engine 22, as well as a HEGO sensor assembly 36. As now defined, the exhaust system 30 further incorporates an engine controller 38. One of the functions of the engine controller 38 is to act as an electrical power control. The HEGO sensor assembly 36 includes a HEGO sensor 42 as well as a heater 44 within (or adjacent) the HEGO sensor 42. See FIGS. 2–4.

The heater 44 includes first and second terminals 46, 48 interconnected to a resistive element 50. In one preferred embodiment, the resistive element 50 is ceramic with metal, resistive, heating fragments imbedded in the ceramic. Power is supplied from the controller 38 to the HEGO heater 44. Approximately 12 volts are applied across the heater terminals 46, 48, under normal operating conditions, such that the heater 44 begins heating the nearby HEGO sensor 42. The voltage is typically first applied when the power switch 32 is rotated to place the engine 22 in an initial condition and turn the engine 22 on. The heat produced allows the HEGO sensor 42 to operate more effectively.

The HEGO sensor 42 includes a sensor tip, or "electrolyte" or "sensing element", 52 and first and second output leads 54, 56. The tip 52 is encased in a protective canister 58, which is screwed into the exhaust pipe 34. The tip 52 contacts gas flowing through the exhaust pipe 34 and detects the exhaust gas composition. In the preferred embodiment, the tip 52 detects the level of oxygen in the gas, and provides an oxygen level signal along the pair of output leads 54, 56 qualitatively representing the oxygen concentration. The signal from the HEGO sensor 42 may be received by the engine controller 38 to influence operation of, for example, the fuel delivery system 28, which may adjust the air/fuel mixture being supplied to the cylinders of the engine 22.

The tip 52 is typically comprised of zirconia dioxide ($ZrO_2$). Zirconia dioxide is particularly suited for oxygen sensing, because of its low electrical conductivity and high oxygen ionic conductivity. The tip 52 is typically surrounded on both the interior and exterior surfaces with porous platinum electrodes 60, 62. The lead 54 is interconnected to the interior platinum electrode 60, while the lead 56 is interconnected to the exterior platinum electrode 62.

The tip 52 provides a voltage differential between the two leads 54, 56 relating to the amount of oxygen adjacent the tip 52. The voltage potential is created by the diffusion of oxygen ions through the ceramic. The lattice structure of $ZrO_2$ has a high concentration of oxygen, compared to the adjacent exhaust gas. Oxygen ions migrate from the inner $ZrO_2$ lattice to the exhaust and reference boundaries. An electrical potential develops from the ionic concentrations, which balance the diffusion potential. High electrical resistance maintains the electrical potential, impeding the back-flow of electrons that would neutralize the electrical potential.

The impedance between the leads 54, 56 is a combination of electrical and ionic impedances. A model may be used in which both the electrical and ionic impedances are deemed parallel to each other. The electrical impedance remains high and relatively stable over the temperature range generally of interest in the present invention. Thus, ionic impedance dominates the overall sensor impedance.

Applicants have noted that the overall sensor impedance is dependent substantially on the temperature of the sensor tip 52. This results because temperature primarily effects the $ZrO_2$ conductivity. Oxygen ions are released from the $ZrO_2$ lattice by the following equation:

$ZrO_2$+thermal energy results in $Zr^{4+}+O_2^{--}$. The $ZrO_2$ output voltage is generated as a result of the free $O_2^{--}$ ions. At a low temperature, however, an effective increase in the ionic impedance occurs from the lack of available oxygen ions.

Applicants have observed that, substantially independent of the oxygen level signal supplied along the pair of output leads 54, 56 by the HEGO sensor 42, the impedance between the output leads 54, 56 of the HEGO sensor 42 is substantially directly related to the temperature of the HEGO sensor 42. Thus, the impedance is substantially directly related to whether or not the heater 44 is satisfactorily performing its function of physically heating the HEGO sensor 42.

Figure 5:
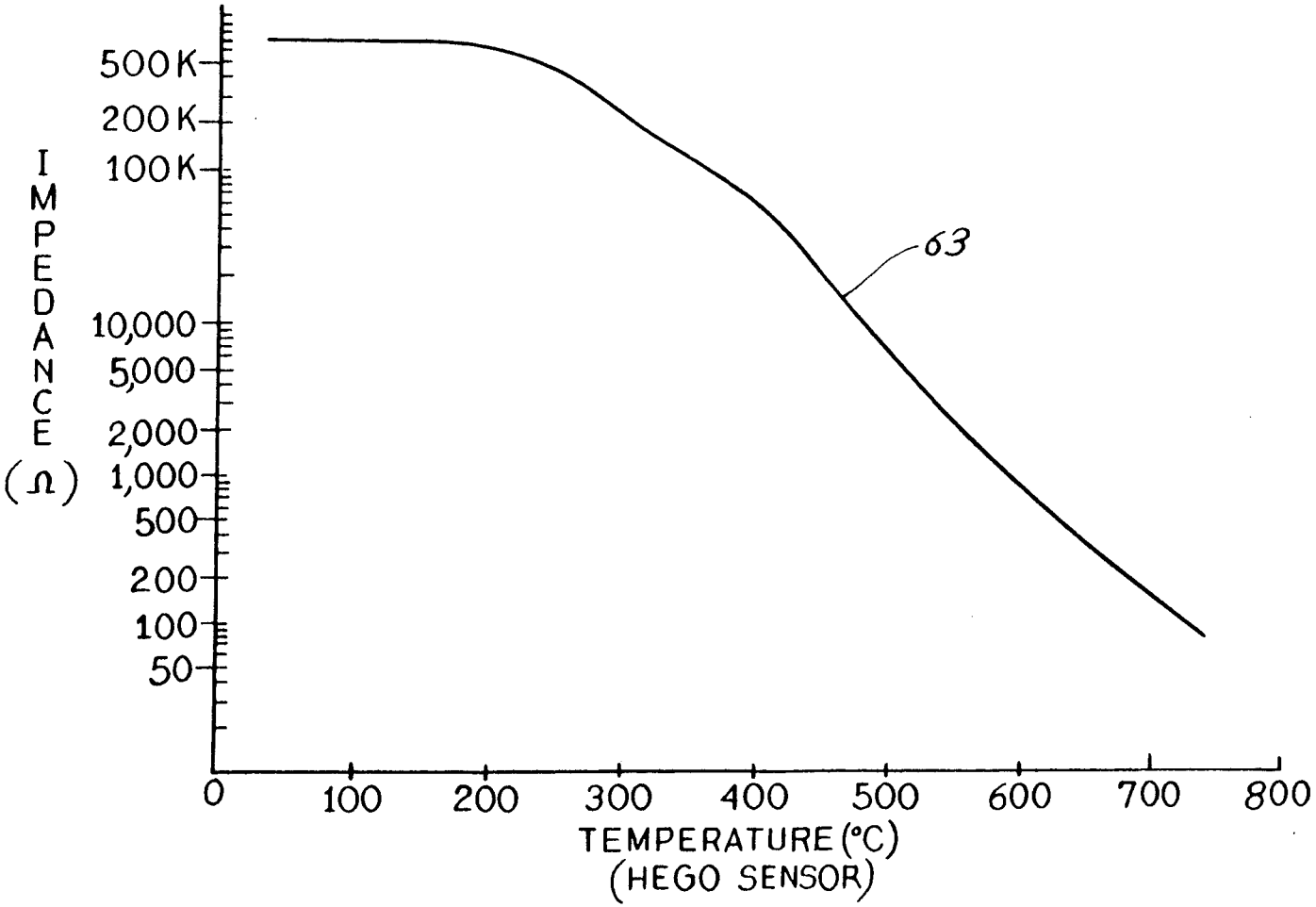
FIG. 5 is a graph showing experimentally measured impedance characteristics, relative to temperature, of a HEGO sensor, such as the sensor shown in FIG. 2.

As shown in FIG. 5, experimentally derived data 63 indicate that the impedance of the HEGO sensor 42 varies substantially directly with its temperature. Thus, for example, a HEGO sensor at a temperature of, for example, 500° C. exhibits an impedance between the pair of output leads 54, 56 of approximately 5 kilohms, while a HEGO sensor at a temperature of 200° C. exhibits an impedance of approximately 500 kilohms.

Accordingly, the present invention relates to measuring the impedance between the output leads 54, 56 of the HEGO sensor 42 itself to make a determination as to whether or not the heater 44 is satisfactorily performing its function. The testing of the heater's performance is substantially independent of the oxygen level signal along the HEGO sensor's output leads 54, 56 or the electrical signal along the heater terminals 46, 48 or the internal resistance of the HEGO heater 44. Moreover, with the present invention, the effect of the heater 44 is directly sensed rather than, for example, performing a diagnostic to ensure, for example, that the HEGO heater 44 does not have an internal short circuit or open circuit.

Figure 6:
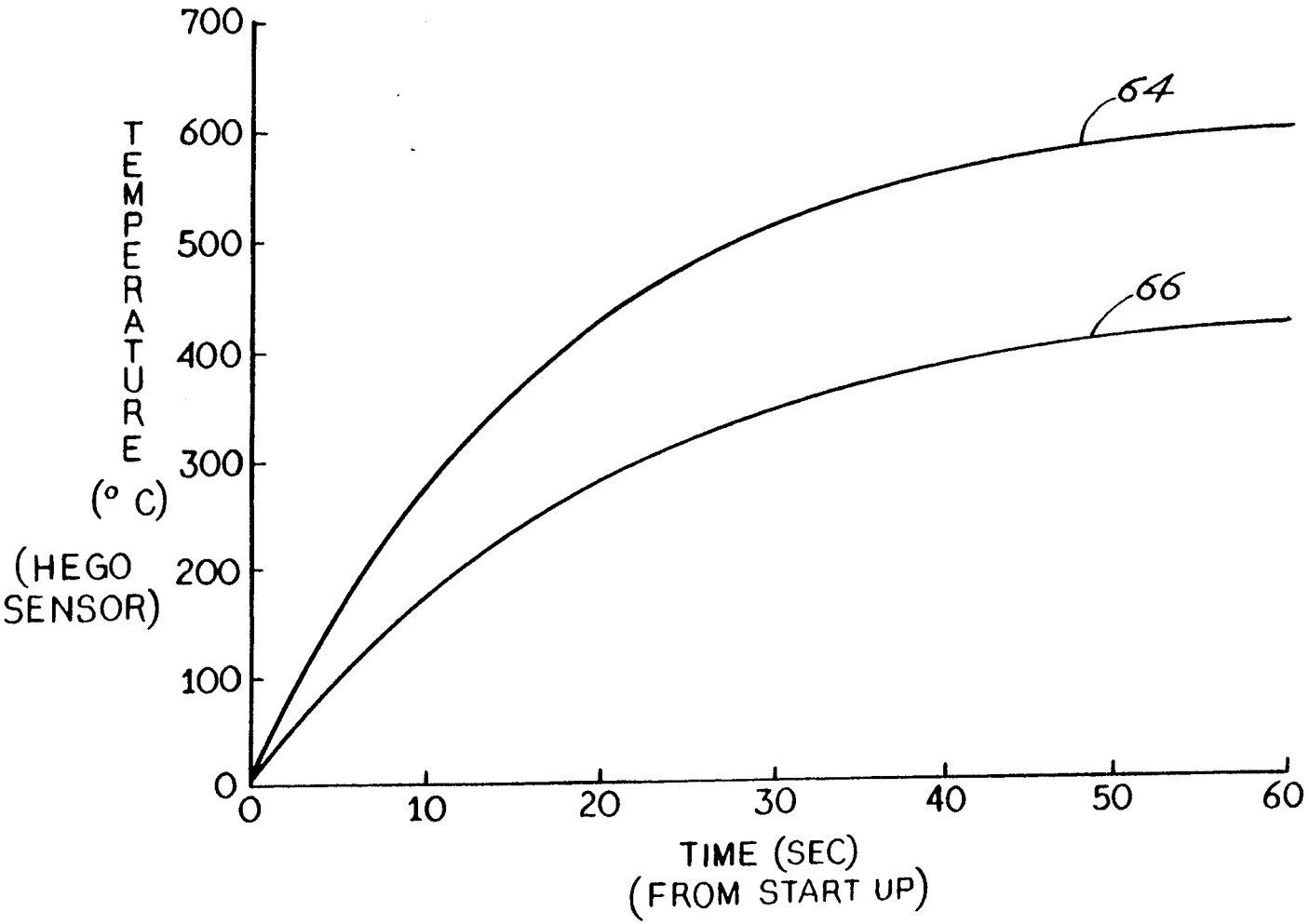
FIG. 6 is a graph showing experimentally measured temperature characteristics of a HEGO sensor, such as the sensor shown in FIG. 2.

After the engine 22 begins operation (such that the internal combustion occurs within the engine block 24 and the crankshaft rotates), the temperature of the exhaust gas in the exhaust pipe 34 increases. FIG. 6 shows experimentally derived data regarding the temperature of the HEGO sensor 42 after an automotive engine 22 has first started. A graph 64 shows the HEGO sensor temperature when the heater 44 is functional, and a graph 66 shows the HEGO sensor temperature when the heater 44 is not functional. The HEGO sensor temperature rises more quickly, and moves to a higher level, when the heater 44 is functioning. Thus, in order to detect a heater malfunction, the sensor assembly 36 makes use of the observation that a HEGO sensor temperature will vary substantially, after only a few seconds of engine operation, depending on whether or not the heater 44 is operational.

For exhaust gas temperatures less than, for example 350° C., a substantial difference in HEGO impedance exists between when the heater 44 is functioning and when the heater 44 is not functioning. When the exhaust gas temperature is 200° C., the difference in impedance is often in excess of 200 kilohms and the ratio of the two impedance levels is at least 2 or 3 to 1.

Figure 7:
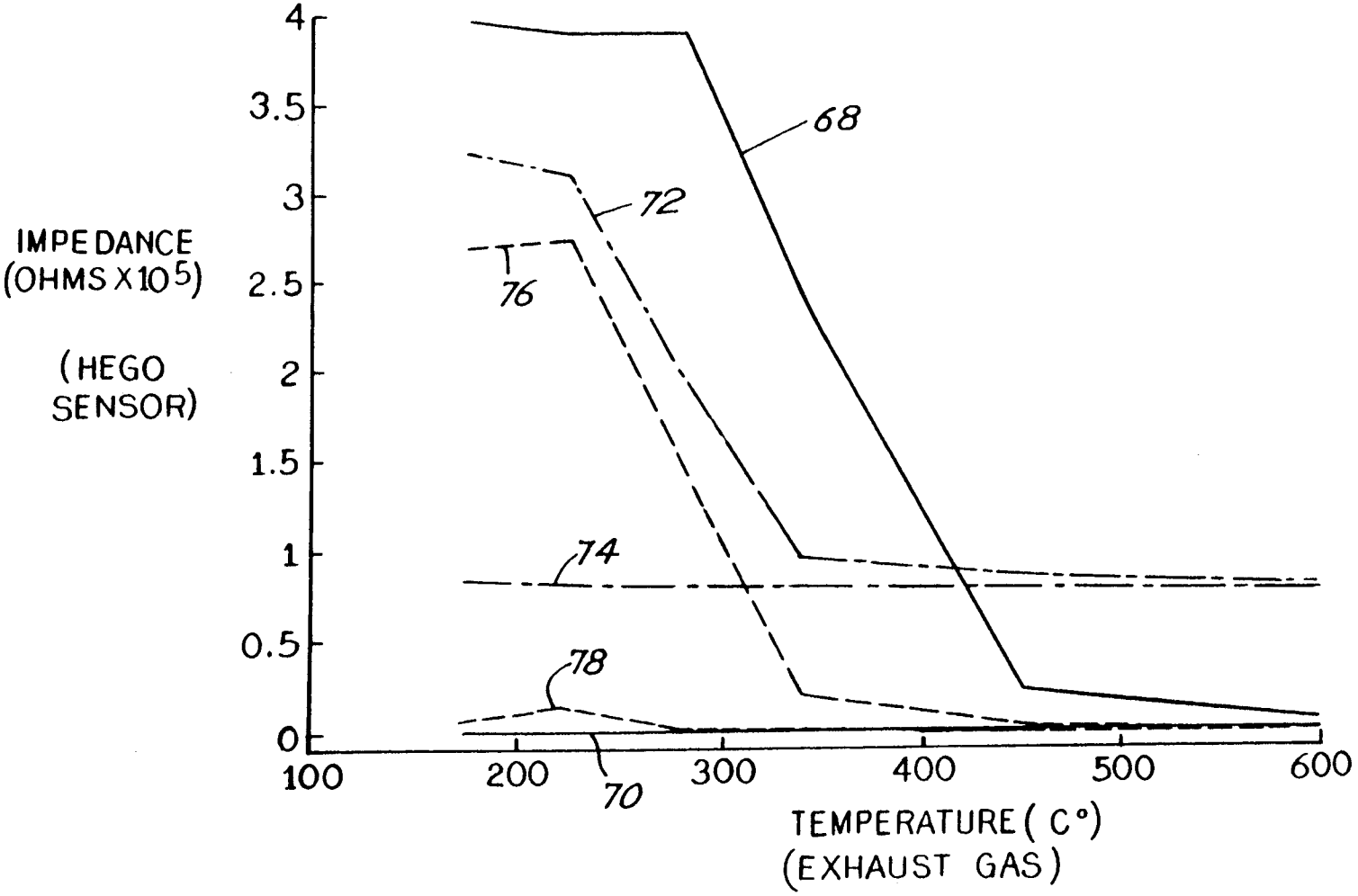
FIG. 7 is a graph showing experimentally measured impedance characteristics, as a function of exhaust gas temperature, of three different types of presently available HEGO sensors, where each of the sensors is similar to the sensor shown in FIG. 2.

The experimentally derived data shown in FIG. 7 confirms that such a relationship is correct for three different types of HEGO sensors tested by applicants for use in automotive vehicles. Lines 68 and 70 show, respectively, the characteristics of a Bosch sensor, with the heater 44 functioning and not functioning. Lines 72 and 74 show, respectively, the characteristics of an NGK sensor, with the heater 44 functioning and not functioning. Lines 76 and 78 show, respectively, the characteristics of an NTK sensor, with the heater 44 functioning and not functioning. The difference in impedance of the sensor 42 between when the heater 44 is or is not working may be utilized by the present invention to detect whether or not the heater 44 is in fact functioning properly.

In one embodiment of the present invention, the heater 44 is activated. An impedance sensor, interconnected to the output leads 54, 56 of the sensor 42, later measures the impedance between the two leads 54, 56. Thereafter, the controller 38 deactivates the heater 44 and, after a predetermined "interval," the controller 38 detects the impedance value of the HEGO sensor 42. (Of course, the "interval" may be a predetermined period of time or the delay for a particular engine parameter, such as coolant temperature, to reach a particular level). The controller 38 then computes the difference between the measured impedance levels and, if the difference is not above a threshold level (such as, for example, 100 kilohms), a heater malfunction signal is issued by the controller 38. Thus, for example, if the difference in "heater off" and "heater on" impedance levels is not at least 100 kilohms (or the ratio of the two values is not at least 2.5 to 1), the heater malfunction signal may be issued. In the present context, a "difference" between impedance values may include both a numerical difference or, for example, a ratio of the values.

Figure 8:
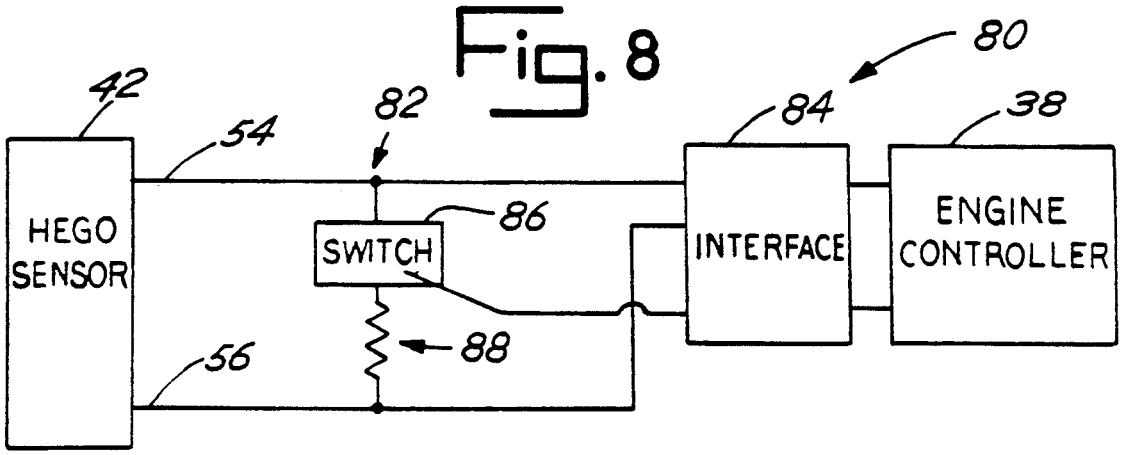
FIG. 8 is a schematic diagram of a preferred embodiment of the present invention utilizing the HEGO sensor shown in FIG. 2.
Figure 9:
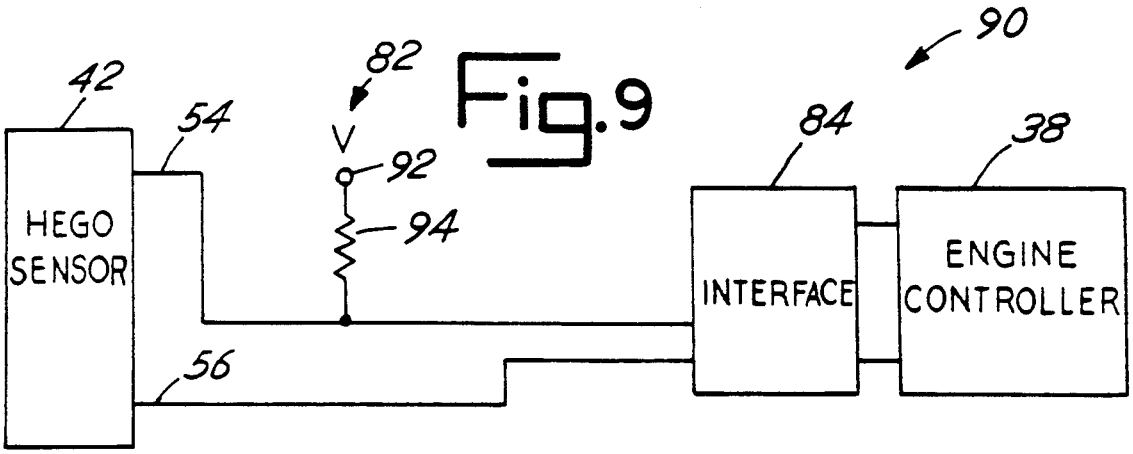
FIG. 9 is an alternative embodiment of the invention shown in FIG. 8.
Figure 10:
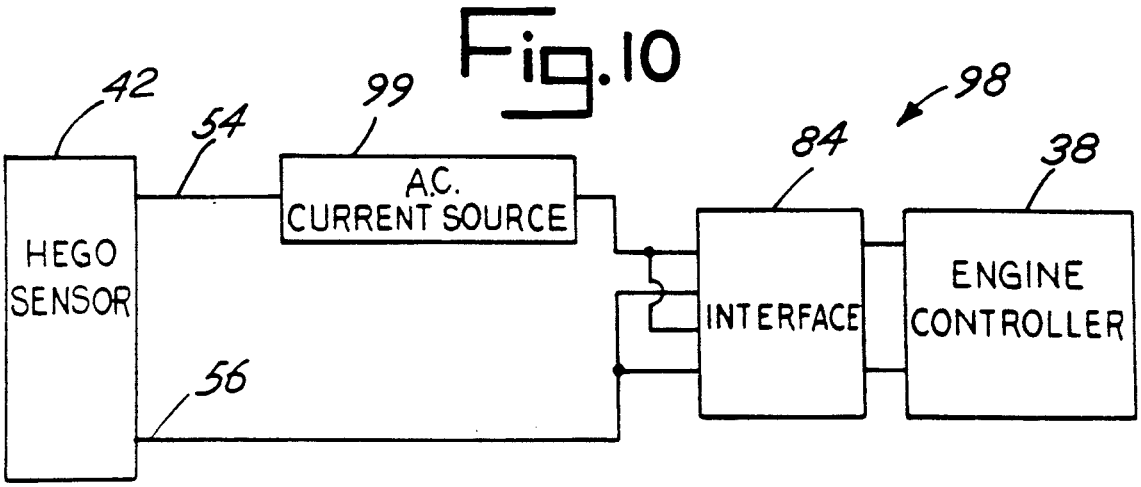
FIG. 10 is an alternative embodiment of the invention shown in FIGS. 8 and 9.

Physical devices for implementing the invention are shown, for example, in FIGS. 8–10. An apparatus 80 is shown in FIG. 8 which includes the HEGO sensor 42 having the first and second leads 54, 56, an assembly 82, microcontroller interface 84, and the microprocessor-based engine controller 38. The assembly 82 includes a switch 86, receiving input from the controller 38, and a load resistor 88 interconnected in series with the switch 86 between the leads 54, 56. The leads 54, 56 supply an analog signal to the controller 38 through the interface 84. The analog signal represents the oxygen level sensed by the HEGO sensor 42 in the exhaust pipe 34.

The switch 86 receives an input from the controller 38 to close, putting the load resistor 88 into the circuit, or to open, taking the load resistor 88 out of the circuit. The controller 38 may then measure the current through the sensor 42 with the load resistor 88 both in and out of the circuit and, thus, determine the impedance between the leads 54, 56. This is done with the engine made rich, i.e., with the HEGO voltage at approximately 1 volt.

In an alternative embodiment shown in FIG. 9, the apparatus 90 shown includes the HEGO sensor 42, assembly 82, interface 84, and controller 38. However, the assembly 82 includes a reference voltage source 92, and a dividing resistor 94. The controller 38 may then measure the voltage drop between the leads 54, 56, compare this voltage with the reference voltage of the source 92, and accordingly determine the impedance between the leads 54, 56.

Alternatively, as shown in FIG. 10, an apparatus 98 includes an Alternating Current source 99. The interface 84 receives both a substantially Direct Current voltage input, so that the controller 38 may determine the oxygen level, and an Alternating Current voltage, so that the controller 38 may determine the impedance between the leads 54, 56. In the preferred embodiments, the internal impedance of the sensor 42 (measured between the leads 54, 56) has been measured at both 100 hertz and 10 kilohertz.

A flow chart showing the process used by the apparatus of FIGS. 8–10 is shown in FIG. 11. At step 100, no tests have been performed on the HEGO heater 44, and, accordingly, a counting number "N" is equal to one. "N" is then incremented at step 102. At step 104, the controller 38 energizes the heater 44. This may coincide with the start up of the engine 22. At step 106, the controller 38 waits a predetermined interval, based on the thermal time constant for the heater 44 to physically warm the HEGO sensor 42.

The interval may be defined in terms of a predetermined interval such as, for example, eight seconds or the delay necessary for an engine parameter to reach a predetermined level. For example, the interval may end as soon as the exhaust gas reaches a temperature of 180° or, alternatively, some time before the exhaust gas reaches a temperature of 400°. After waiting a predetermined interval of, for example, eight seconds, at step 108, the controller 38 measures the "heater-on" impedance between the leads 54, 56 and records this as a "heater-on" impedance in memory.

Thereafter, the controller 38 deactivates the heater 44, at step 110, and, at step 112, the controller 38 waits a predetermined period of time (such as, for example, ten or twenty seconds) based on the thermal time constant for the sensor 42 to "cool off." Thereafter, at step 114 the controller 38 measures the impedance between the leads 54, 56, and this impedance is designated as a "heater-off" impedance.

At step 116, if "N" is equal to a predetermined number, such as one or two or ten, and if "N" has not reached the predetermined number, the process is continued, with the controller 38 returning to step 102. Alternatively, however, if a sufficient number of iterations have been performed, the controller 38 may then compute, at steps 117, 118, a typical "heater-on" value and a typical "heater-off" value from the values stored in memory. In the preferred embodiment, the controller 38 simply averages all of the last "N" "heater-on" impedances to arrive at the typical "heater-on" impedance, and averages all of the last "N" "heater-off" impedances to determine the typical "heater-off" impedance.

Thereafter, at step 120, the controller 38 computes a ratio of the "heater-on" impedances to "heater-off" impedances. At step 122, the ratio is compared to a threshold. If, for example, the "heater-off" impedance relative to the "heater-on" impedance is less than, for example, three or four, the controller 38 determines, at step 124, that the heater 44 is operating properly. After another predetermined period of time, the entire testing process may be repeated, starting again at step 100.

Alternatively, however, if the ratio is below the predetermined threshold, the heater 44 is determined, at step 126, to have malfunctioned. Accordingly, the controller 38 issues a heater malfunction signal to cause the initiation of an alarm.

The alarm may comprise, for example, a light 128 on the dashboard (see FIG. 1), such that the operator of the vehicle or automotive mechanic can be alerted to the detected malfunctioning of the HEGO heater 44. Thus, the present invention may test the HEGO heater 44 as frequently as desired while the engine 22 operates, through the activation and deactivation of the heater, without the necessity of turning off or otherwise discontinuing the operation of the engine 22. Moreover, the vehicle driver may be immediately notified that the heater 44 has malfunctioned, so that corrective action may be taken promptly.

The number of iterations performed before determining typical "heater-on" and "heater-off" values may be, for example, only one, if a quick determination is required. Alternatively, however, if the impedance measurements are vary substantially because of component variations or environmental conditions, a larger number of iterations, such as five or ten or more, may be performed before computing a typical value. The use of a large number of iterations effectively negates the significance of a spurious impedance reading conclusion.

Thus, the present system 20 is dynamic, in that it changes the condition of the heater 44 from activated or to deactivated, or from energized to deenergized, as the automotive engine 22 continues to operate. By turning the heater 44 on and off, the system 20 is able to perform repetitive measurements and reduce the chance of a false reading.

Preferred embodiments of the present invention have been described herein. It is to be understood, however, that changes and modifications can be made without departing from the true scope and spirit of the present invention. This true scope and spirit are defined by the following claims and their equivalents, to be interpreted in light of the foregoing specification.

We claim:

1. A heated exhaust gas oxygen sensor assembly for an internal combustion engine comprising, in combination:

an oxygen sensor, having a sensing element and a pair of output leads, for detecting oxygen with said sensing element and responsively issuing an oxygen level signal along said pair of output leads;

a heater for warming said oxygen sensor;

an impedance sensor, interconnected to said pair of output leads, for measuring impedance between said output leads and issuing an impedance signal; and a controller, interconnected to said heater and impedance sensor for following a heater sequence of activating said heater and then deactivating said heater and for receiving said impedance signal when said heater is both on and off, comparing said heater impedance represented by said impedance signals to determine an impedance difference, and issuing a heater malfunction signal when said impedance difference is less than a predetermined threshold.

2. An assembly as claimed in claim 1 wherein said heater sequence is comprised of:

activating said heater;

waiting a first predetermined interval;

deactivating said heater; and waiting a second predetermined interval.

3. An assembly as claimed in claim 2 wherein said controller follows said heater sequence at least twice;

wherein said controller determines a typical heater-on value corresponding to said heater impedance after said first predetermined interval and a typical heater-off value corresponding to said heater impedance after said second predetermined interval; and wherein said controller compares said heater impedance levels represented by said typical heater-on value and typical heater-off value to determine said impedance difference.

4. An assembly as claimed in claim 3 wherein said typical heater on value is substantially equal to an average of said heater impedance after said first predetermined interval; and wherein said typical heater off value is substantially equal to an average of said heater impedance after said second predetermined interval.

5. An assembly as claimed in claim 2 wherein said controller begins said heater sequence after said engine has operated for a predetermined interval.

6. An assembly as claimed in claim 5 wherein said impedance difference comprises a ratio between said impedance signals when said heater is both on and off.

7. An assembly as claimed in claim 1 further comprising an alarm, interconnected to said controller, for receiving said heater malfunction signal and responsively indicating that said heater is malfunctioning.

8. A process for determining whether a heater for an exhaust gas oxygen sensor has malfunctioned, said heater warming said oxygen sensor, and said oxygen sensor, detecting oxygen in a gas input and responsively issuing an oxygen level signal along a pair of output leads, comprising the steps of:

activating said heater;

waiting a first predetermined interval;

measuring an impedance between said output leads of said sensor to determine a heater-on impedance;

deactivating said heater;

waiting a second predetermined interval;

measuring an impedance between said output leads of said sensor to determine a heater-off impedance; and comparing said heater on and heater off impedances to determine an impedance difference and issuing a heater malfunction signal when said impedance difference is less than a predetermined threshold.

9. A process for determining whether a heater for an exhaust gas oxygen sensor has malfunctioned, said heater warming said oxygen sensor, and said oxygen sensor detecting oxygen in a gas input and responsively issuing an oxygen level signal along a pair of output leads, comprising the steps of:

activating said heater;

waiting a first predetermined interval;

measuring an impedance between said output leads of said sensor to determine a first heater-on impedance;

deactivating said heater.

waiting a second predetermined interval;

measuring an impedance between said output leads of said sensor to determine a first heater-off impedance;

activating said heater;

waiting said first predetermined interval;

measuring an impedance between said output leads of said sensor to determine a second heater-on impedance;

deactivating said heater;

waiting said second predetermined interval;

measuring a heater impedance between said output leads of said sensor to determine a second heater-off impedance;

determining a typical heater on value corresponding to said impedance after said first predetermined intervals and a typical heater off value corresponding to said impedance after said second predetermined intervals;

comparing said impedance levels represented by said typical heater on value and typical heater off values to determine an impedance difference; and issuing a heater malfunction signal when said difference is less than a predetermined threshold.

10. A process as claimed in claim 9 wherein said step of determining a typical heater on value comprises the step of determining an average of said impedance after said first predetermined period of time; and wherein said step of determining said typical heater off value comprises the step of determining an average of said impedance after said second predetermined period of time.

11. A process as claimed in claim 10 further comprising the steps of detecting that said engine has begun operation and waiting a predetermined interval before said step of activating said heater initially.

12. A process as claimed in claim 11 wherein said impedance difference comprises a ratio between said impedance signals when said heater is both on and off.

* * * * *